US007669782B2

(12) United States Patent
Wang et al.

(10) Patent No.: US 7,669,782 B2
(45) Date of Patent: Mar. 2, 2010

(54) LIQUID ATOMIZER

(75) Inventors: Liang De Wang, Tainan (TW); Tai-Feng Wu, Tainan County (TW); Yi-Cheng Chen, Taipei County (TW); Yu-Ran Wang, Taipei County (TW); Chien-Shien Yeh, Tainan County (TW); Sheng-Chih Shen, Tainan County (TW)

(73) Assignee: Industrial Technology Research Institute, Hsin Chu Hsien (TW)

( * ) Notice: Subject to any disclaimer, the term of this patent is extended or adjusted under 35 U.S.C. 154(b) by 328 days.

(21) Appl. No.: 11/707,147

(22) Filed: Feb. 16, 2007

(65) Prior Publication Data

US 2008/0073447 A1 Mar. 27, 2008

(30) Foreign Application Priority Data

Sep. 25, 2006 (TW) ..... 95135384 A

(51) Int. Cl.
*B05B 1/08* (2006.01)

(52) U.S. Cl. ..... 239/102.1; 239/102.2; 239/552; 239/556; 239/596

(58) Field of Classification Search ..... 239/102.1, 239/102.2, 552, 556, 596; *B05B 17/06*
See application file for complete search history.

(56) References Cited

U.S. PATENT DOCUMENTS 4,530,464 A * 7/1985 Yamamoto et al. ..... 239/102.2
4,533,082 A 8/1985 Maehara et al.
4,632,311 A * 12/1986 Nakane et al. ..... 239/101
5,823,428 A * 10/1998 Humberstone et al. ..... 239/4
6,550,691 B2 * 4/2003 Pence ..... 239/102.2

* cited by examiner

*Primary Examiner*—Dinh Q Nguyen
(74) *Attorney, Agent, or Firm*—Birch, Stewart, Kolasch & Birch, LLP

(57) ABSTRACT

The present invention provides a liquid atomizer for atomizing liquid and applied in an atomizing device having an accommodating space and a through hole. The liquid atomizer includes a vibrating element having a first hole corresponding to the through hole; a spray plate having a plurality of spraying holes corresponding to the first hole and being connected with the vibrating element; and a structure element having a second hole corresponding to the plurality of spraying holes of the spray plate and being connected with the spray plate so that the spray plate is disposed between the vibrating element and the structure element. The vibrating element, the spray plate and the structure element are assembled in the accommodating space of the atomizing device. Liquids are atomized via the spraying holes of the spray plate.

8 Claims, 5 Drawing Sheets

LIQUID ATOMIZER

BACKGROUND OF THE INVENTION

1. Field of the Invention

The present invention relates to a liquid atomizer, more particularly a kind of liquid atomizer capable of reducing noise, improving the service life of spray plate, preventing working frequency drift, and enhancing the atomization efficiency.

2. Description of the Related Art

Liquid atomizer currently available on the market comes in pressure type and mechanical oscillation type. The former atomizes liquid using pressure gradient and is able to atomize large amount of liquid. But pressure-type atomizer requires machine for pressurization, and generates greater noise. For medical atomizer, only small amount of liquid needs to be atomized, but the size of droplet produced is an important consideration. Thus the medical application of pressure-type atomizer gradually loses its appeal. Mechanical oscillation type atomizer has been the dominant type of medical atomizer in recent years that largely uses ultrasonic vibration generated by piezoelectric material to atomize liquid. But it also has the drawbacks of consuming too much power and requiring fans to direct the flow of droplet mist.

Aside from the ultrasonic atomization just described, there are piezoelectric atomizers that use spray plate to generate droplet mist. The use of spray plate greatly reduces the consumption of electric energy and better controls the droplet sizes through the working of pore size. Related patents or products of such atomizer can be generally categorized into two types: using the vibration of piezoelectric material to push the liquid through the spray holes to form mist, or using piezoelectric material to vibrate a spray plate causing it to push out the liquid, which turns into mist form after passing through the spray holes. The former requires greater energy to drive the piezoelectric material in order to atomize the liquid and generate smaller droplets, and is less efficient as compared to the latter. The latter contains spray plate, which is an active vibration component prone to fatigue. Other problems associated with the latter type of piezoelectric atomizers include noise during liquidless air vibration, reduced service life of spray plate in case of large-area vibration, working frequency drift following air vibration, and low atomization efficiency.

The liquid atomizer 60 in a typical atomizing device that uses active vibration component includes a vibrating element 70 and a spray plate 80. As shown in FIG. 6, the spray plate 80 vibrates under the driving of vibrating element 70 and generates squeeze pressure to push the liquid out of spray holes 81 and form droplet mist.

In the atomization process just described, the entire spray plate would vibrate under the driving of vibrating element for it is adhered to the vibrating element. Because of increase in its vibration area, the spray plate tends to fatigue easily, and increase in the spray plate load reduces the atomization efficiency.

As such, how to reduce the vibration area of the spray plate in the atomization process, enhance the service life of spray plate and improve the atomization efficiency, and prevent working frequency drift are problems that need to be addressed.

SUMMARY OF THE INVENTION

The object of the present invention is to provide a liquid atomizer that reduces noise.

Another object of the present invention is to provide a liquid atomizer that enhances the service life of spray plate.

A further object of the present invention is to provide a liquid atomizer that prevents the working frequency drift.

Yet another object of the present invention is to provide a liquid atomizer that improves atomization efficiency.

To achieve the aforesaid objects, the present invention provides a liquid atomizer for atomizing liquid and applied in an atomizing device having an accommodating space and a through hole. The liquid atomizer includes a vibrating element having a first hole corresponding to the through hole; a spray plate having a plurality of spraying holes corresponding to the first hole and being connected with the vibrating element; and a structure element having a second hole corresponding to the plurality of spraying holes of the spray plate and being connected with the spray plate so that the spray plate is secured between the vibrating element and the structure element. The vibrating element, the spray plate and the structure element are assembled in the accommodating space of the atomizing device. Under the vibration energy generated by the vibrating element, liquids are atomized via the spraying holes of spray plate.

To achieve the aforesaid objects, the present invention provides another liquid atomizer for atomizing liquid and applied in an atomizing device having an accommodating space and a through hole. The liquid atomizer includes a vibrating element having an elastic body and a first hole corresponding to the through hole; a spray plate having a plurality of spraying holes corresponding to the first hole and being connected with the vibrating element so that the elastic body is disposed between the vibrating element and the spray plate; and a structure element having a second hole corresponding to the plurality of spraying holes of the spray plate and being connected with the spray plate so that the spray plate is disposed between the vibrating element and the structure element. The vibrating element, the spray plate and the structure element are assembled in the accommodating space of the atomizing device. Under the vibration energy generated by the vibrating element, liquids are atomized via the spraying holes of the spray plate.

The liquid atomizer can further include an inlet for the injection of liquid to be atomized into a cavity. The vibrating element is a piezoelectric plate. The structure element is made of plastic material.

The elastic body is made of plastic material. The spray plate is secured between the vibrating element and the structure element with adhesive.

The vibrating element is configured with a first hole corresponding to the through hole. The spray plate is configured with a plurality of spraying holes corresponding to the first hole. The structure element is configured with a second hole corresponding to the plurality of spraying hole. The diameter of the second hole is smaller than that of the first hole.

The second hole is in one of shapes of bowl, fillet or chamfer.

DETAILED DESCRIPTION OF THE INVENTION

The present invention will be fully described with preferred embodiments and accompanying drawings. It should be understood beforehand that any person familiar with the skill is able to make modification to the invention described and attain the same effect, and that the description below is a general representation to people familiar with the skill and should not be construed as a limitation on the actual applicable scope of the present invention.

Figure 1:
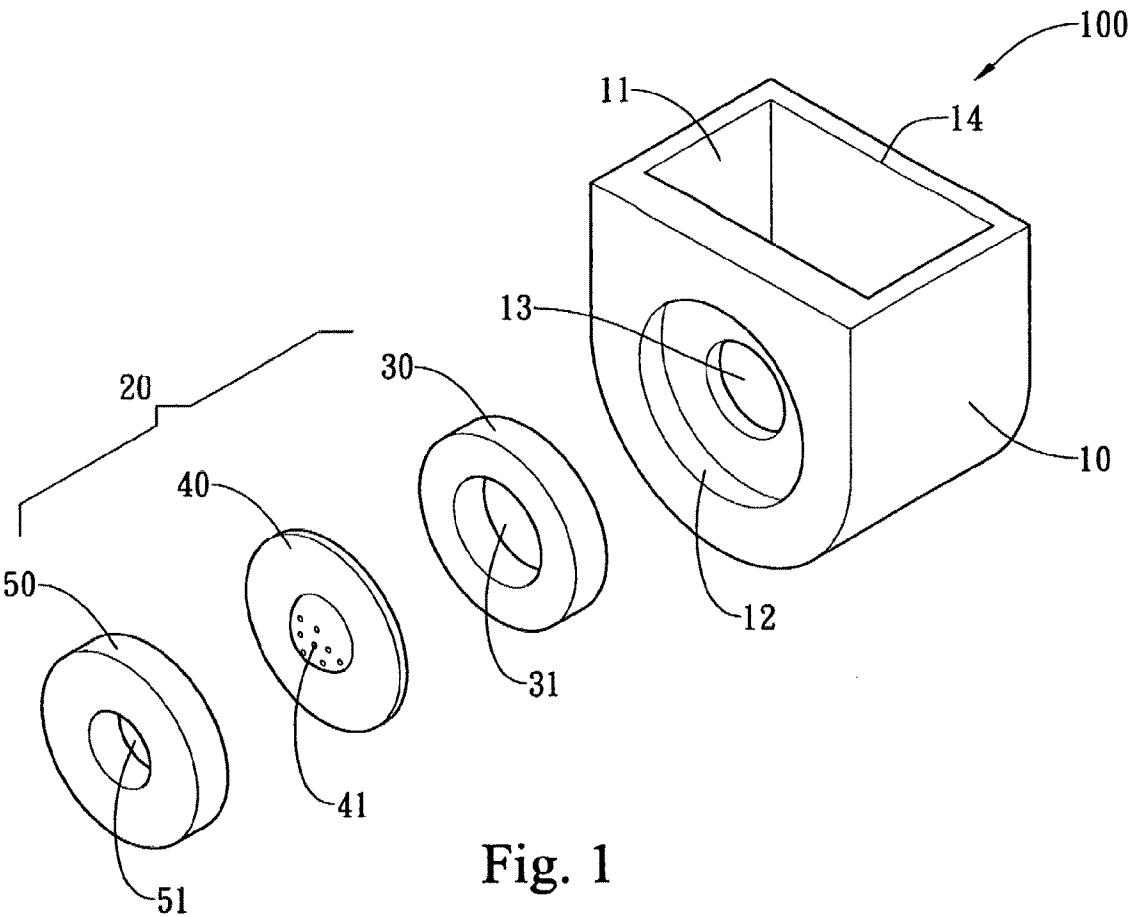
FIG. 1 is the exploded perspective view of a liquid atomizer of the present invention applied in an atomizing device.
Figure 6:
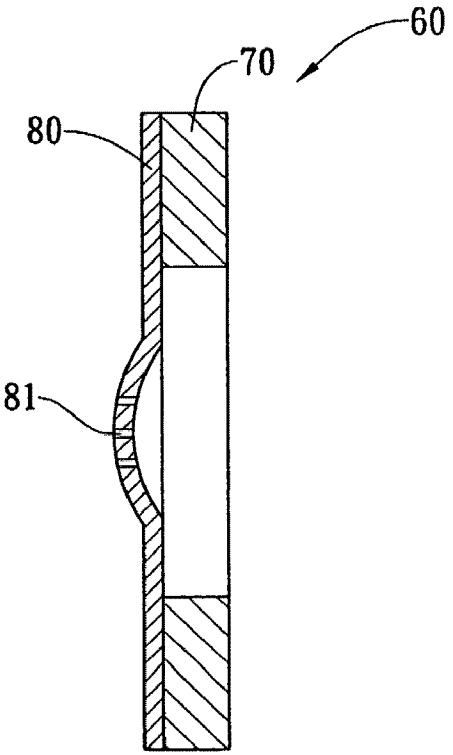
Fig. 6 (Prior Art)
FIG. 6 is the side sectional view of a conventional liquid atomizer.

FIG. 1 shows the exploded perspective view of a liquid atomizer of the present invention applied in an atomizing device. The liquid atomizer 20 of the present invention comprises a vibrating element 30, a spray plate 40, and a structure element 50. The atomizing device includes a body 10 having a cavity 11 for storing liquid to be atomized (not shown in the figure) and an accommodating space 12 and a through hole 13 provided on one side of the body 10. The liquid atomizer 20 is disposed inside the accommodating space 12 of body 10.

The body 10 further includes an inlet 14 for the injection of liquid to be atomized into the cavity 11. On occasions where continuous atomization is desired for, for example, humidity control, the inlet 14 can be connected to the source of continuous liquid supply for atomizing device 100 to work for long period of time. The space of cavity 11 can be adjusted according to needs for storing the liquid to be atomized. The atomizing device 100 can be used as a detached device in medical application for patients to carry around.

The vibrating element 30 is configured with a first hole 31 corresponding to the through hole 13. In this embodiment, the vibrating element 30 is a piezoelectric material for providing vibration energy.

The spray plate 40 is configured with a plurality of spraying holes 41 corresponding to the first hole 31 and connected with the vibrating element 30.

The structure element 50 is configured with a second hole 51 corresponding to the plurality of spraying holes 41 of the spray plate 40 and connected with the spray plate 40 so that the spray plate 40 is secured between the vibrating element 30 and structure element 50. The assembled vibrating element 30, spray plate 40 and structure element 50 are disposed in the accommodating space 12 of body 10. Under the vibration energy generated by the vibrating element 30, liquids are atomized via the spraying holes 41 of spray plate 40. The structure element 50 is made of plastic material.

Figure 2:
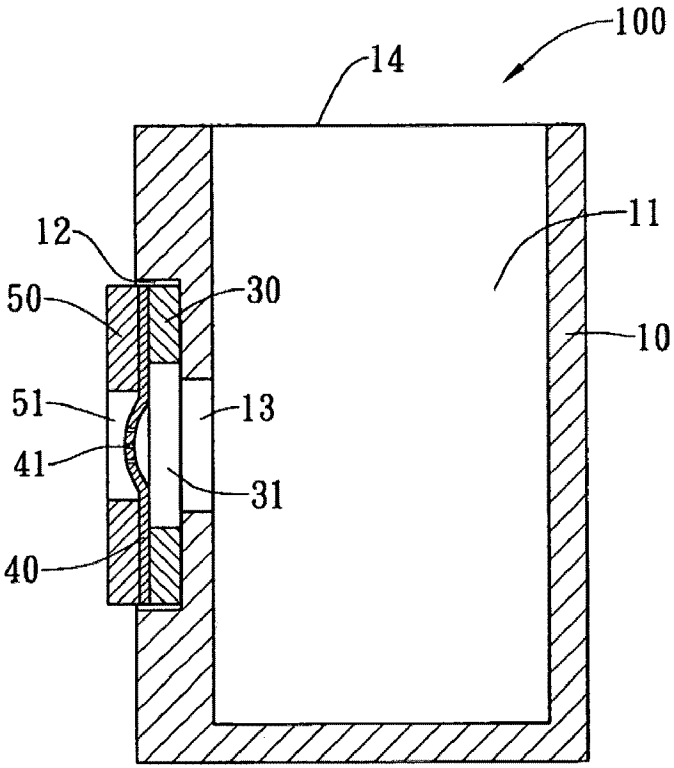
FIG. 2 is the side sectional view of a liquid atomizer applied in an atomizing device according to the present invention.

FIG. 2 is the side sectional view of a liquid atomizer applied in an atomizing device according to the present invention. Referring to FIG. 1 and FIG. 2, the liquid atomizer 20 is secured in the accommodating space 12 of body 10, while spray plate 40 is secured between vibrating element 30 and structure element 50 with adhesive. The diameter of the first hole 31 of vibrating element 31 is bigger than that of the second hole 51 of structure element 50, so that when liquid atomizer 20 works, the vibration area of spray plate 40 is reduced and the atomization area is confined to the center portion where vibration amplitude is the biggest. As such, vibration of the spray plate 40 in unnecessary area is effectively eliminated, and the load of spray plate 40 is reduced, thereby prolonging its service life. As vibration energy is confined to the center of spray plate 40, unnecessary energy consumption is reduced, thereby achieving the object of enhancement.

When the atomizing device 100 is to be activated, liquid to be atomized is first injected into the cavity 11 of body 10 via the inlet 14 and flows through the through hole 13 of body 10 into the liquid atomizer 20, and then through the first hole 31 of vibrating element 30 to the spray plate 40. The vibration energy generated by the vibrating element 30 drives the spray plate 40 to vibrate, which produces squeeze pressure on liquid and forces it out of the spray holes 41 to form mist.

Figure 3C:
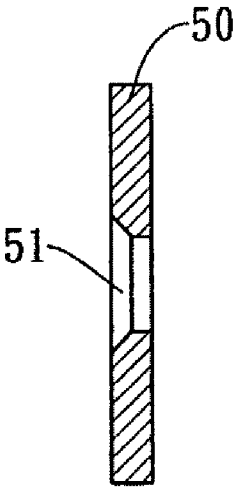
FIG. 3C is the side sectional view of the structure element of a liquid atomizer according to yet another embodiment of the present invention.
Figure 3B:
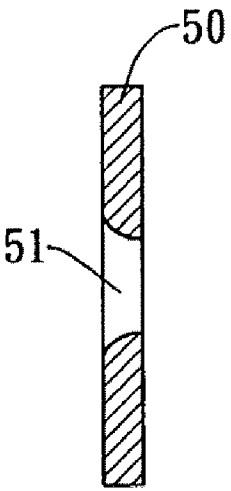
FIG. 3B is the side sectional view of the structure element of a liquid atomizer according to yet another embodiment of the present invention.
Figure 3A:
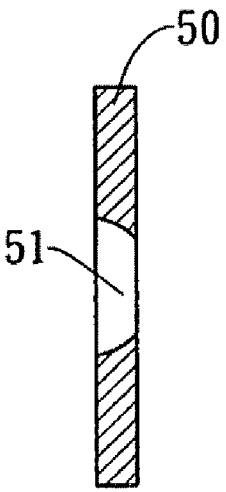
FIG. 3A is the side sectional view of the structure element of a liquid atomizer according to another embodiment of the present invention.

FIGS. 3A~3C are embodiments of the structure element of liquid atomizer according to the present invention. In those embodiments, the second hole 51 of structure element 50 tapers in correspondence to the spray plate 40 to produce a diffusional atomization effect.

In those embodiments, the second hole 51 of structure element 50 tapers in a bowel, fillet or chamfer shape as shown in FIG. 3A, FIG. 3B and FIG. 3C respectively.

Figure 4A:
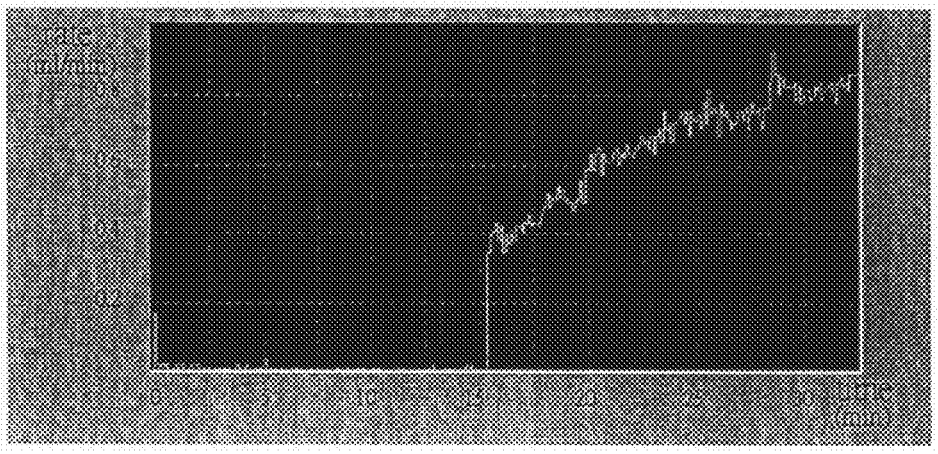
FIG. 4A shows the recovery waveform of a liquid atomizer according to the present invention following air vibration.
Figure 4B:
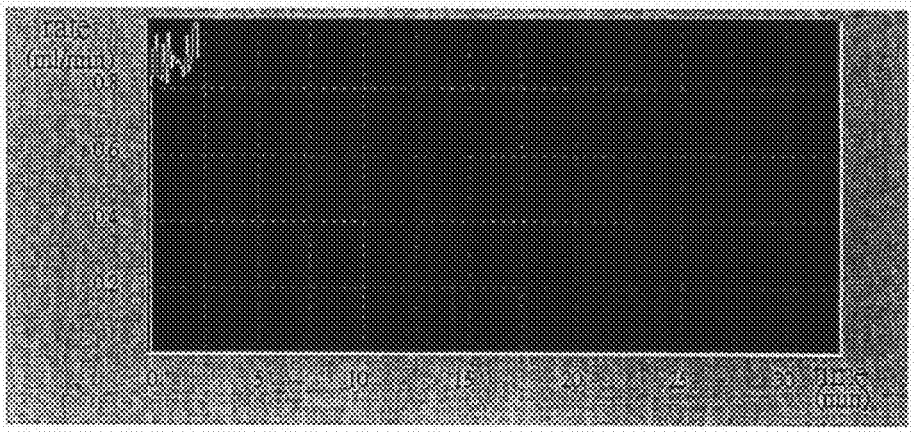
FIG. 4B shows the recovery waveform of a conventional liquid atomizer following air vibration.

FIG. 4A shows the recovery waveform of a liquid atomizer following air vibration according to the present invention. FIG. 4B shows the recovery waveform of a conventional liquid atomizer following air vibration. When liquid atomizer of prior art vibrates without liquid, it tends to vibrate in low-frequency mode and generate unpleasant noise. The liquid atomizer according to the present invention has a structure element to secure the spray plate, thereby stabilizing the vibration frequency, reducing the occasion of low-frequency vibration and reducing the generation of noise. This feature is important for liquid atomizer used in medical applications, for it can help sooth the mood of patient and improve the therapeutic effect.

With respect to adding in liquid for atomization following air vibration, the liquid atomizer according to the invention has better recovery curve. As shown in FIG. 4A, the vibration frequency of liquid atomizer of the invention does not exhibit drift with the addition of liquid after it vibrates in air for a period of time. Thus its atomization rate reverts back to the initial state almost instantaneously. In contrast to the recovery curve of prior art, it is shown in FIG. 4B that the working frequency of conventional liquid atomizer would recover slowly when liquid is added after it vibrates in air for a period of time. The working frequency drift results in slowdown of atomization rate. Thus the liquid atomizer of the invention helps improve the quality of atomizing device significantly as it is not necessary to adjust the working frequency each time the device is in use, making the use of atomizing device more convenient.

Figure 5:
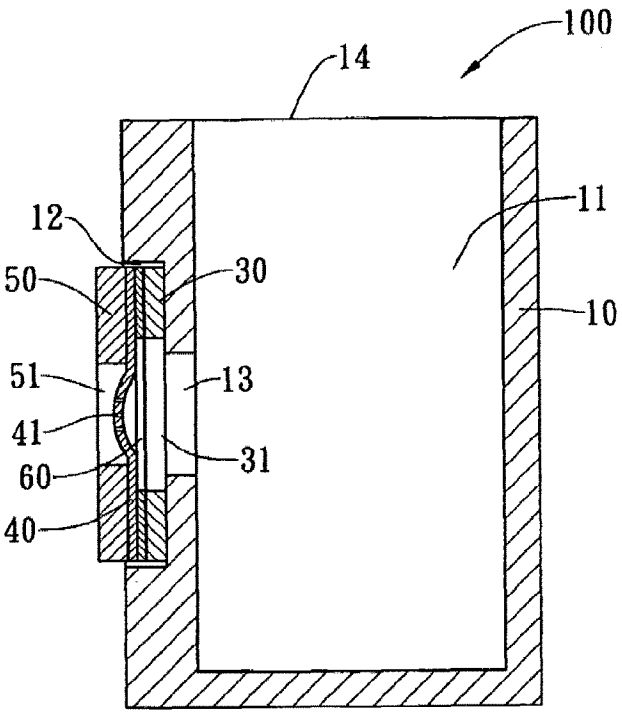
FIG. 5 is the side sectional view of a liquid atomizer applied in an atomizing device according to another embodiment of the present invention.

FIG. 5 is the side sectional view of a liquid atomizer applied in an atomizing device according to another embodiment of the present invention. Elements in this embodiment identical or similar to those of the embodiment in FIG. 1 are expressed by identical or similar symbols and detailed descriptions are omitted to render the description of the present invention clearer and easily comprehensible.

The liquid atomizer 20 in this embodiment has basically the same elements as the liquid atomizer presented in FIG. 1. The main difference is that vibrating element 30 of liquid atomizer 20 here has an elastic body 60, which is disposed between the vibrating element 30 and spray plate 40. When the liquid atomizer 20 is in action, vibration energy is generated so that an oscillating force is present between vibrating element 30 and spray plate 40. The elastic body 60 works to buffer the oscillating force present between vibrating element 30 and spray plate 40. In this embodiment, elastic body is made of plastic material.

To sum up, the liquid atomizer of the present invention can confine the vibration area of spray plate when it is in action, so that the vibration of peripheral area that does not aid the atomization can be stopped and energy can be concentrated in the center area. As such, atomization rate is increased and more energy is saved. As compared to the spray plate of prior art, the spray plate of the present invention has stronger structure so that its periphery will not become detached from a structure it is adhered to after repeated vibration, which also addresses the liquid seepage problem. Furthermore, less area of the spray plate is subject to fatigue effect, and breakage of spray plate during air vibration is less likely to occur, thereby prolonging its service life.

The preferred embodiments of the present invention have been disclosed in the embodiments. However the embodiments should not be construed as a limitation on the actual applicable scope of the invention, and as such, all modifications and alterations without departing from the spirits of the invention and appended claims shall remain within the protected scope and claims of the invention.

What is claimed is:

1. A liquid atomizer for atomizing liquid and applied in an atomizing device having a through hole, comprising:

a body having a cavity for storing liquid to be atomized, an accommodating space and the through hole provided on one side of the body a vibrating element having a first hole corresponding to said through hole, wherein said vibrating element is a piezoelectric plate;

a spray plate having a plurality of spraying holes corresponding to said first hole and connected with said vibrating element; and a structure element having a second hole in one of shapes of bowel, fillet or chamfer corresponding to said plurality of spraying holes of said spray plate and connected with said spray plate so that said spray plate is secured between said vibrating element and said structure element with adhesive; said vibrating element, said spray plate and said structure element being assembled in the accommodating space of said atomizing device to atomize the liquid via said spraying holes of said spray plate.

2. The liquid atomizer according to claim 1, wherein said structure clement is made of plastic material.

3. The liquid atomizer according to claim 1, wherein a diameter of said second hole is smaller than that of said first hole.

4. A liquid atomizer for atomizing liquid and applied in an atomizing device having a through hole, comprising:

a body having a cavity for storing liquid to be atomized, an accommodating space and the through hole provided on one side of the body a vibrating element having an elastic body and a first hole corresponding to said through hole, wherein said vibrating element is a piezoelectric plate;

a spray plate having a plurality of spraying holes corresponding to said first hole and connected with said vibrating element so that said elastic body is disposed between said vibrating element and said spray plate; and a structure element having a second hole in one of shapes of bowel, fillet or chamfer corresponding to said plurality of spraying holes of said spray plate and connected with said spray plate so that said spray plate is secured between said vibrating element and said structure element; said vibrating element, said spray plate and said structure element being assembled in the accommodating space of said atomizing device to atomize the liquid via said spraying holes of said spray plate.

5. The liquid atomizer according to claim 4, wherein said structure element is made of plastic material.

6. The liquid atomizer according to claim 4, wherein said elastic body is made of plastic material.

7. The liquid atomizer according to claim 4, wherein said spray plate is secured between said vibrating element and said structure element with adhesive.

8. The liquid atomizer according to claim 4, wherein a diameter of said second hole is smaller than that of said first hole.

* * * * *